US009429017B2

(12) United States Patent
Brunner et al.

(10) Patent No.: US 9,429,017 B2
(45) **Date of Patent: *Aug. 30, 2016**

(54) METHOD AND SYSTEM OF COAL MINE ROOF STABILIZATION

(71) Applicant: REI, Inc., Salt Lake City, UT (US)

(72) Inventors: Daniel J. Brunner, Sandy, UT (US); Jeffrey D. Jorgensen, Murray, UT (US); Jeffrey G. Burton, Farmington, UT (US); Jeffrey J. Schwoebel, Crozet, VA (US); Michael J. Hardin, Draper, UT (US); Forrest Paul Schumacher, Salt Lake City, UT (US)

(73) Assignee: REI, Inc., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/790,263

(22) Filed: Jul. 2, 2015

(65) Prior Publication Data

US 2015/0300168 A1 Oct. 22, 2015

Related U.S. Application Data

(63) Continuation of application No. 12/983,088, filed on Dec. 31, 2010, now Pat. No. 9,080,444.

(60) Provisional application No. 61/292,066, filed on Jan. 4, 2010.

(51) Int. Cl.

| | |
|---|---|
| ***E21D 21/00*** | (2006.01) |
| ***E21D 20/00*** | (2006.01) |
| ***E21D 11/00*** | (2006.01) |

(Continued)

(52) U.S. Cl.

CPC ..... *E21D 11/006* (2013.01); *E21B 4/02* (2013.01); *E21B 7/068* (2013.01); *E21D 11/155* (2013.01); *E21D 11/403* (2013.01); *E21D 20/00* (2013.01); *E21D 20/003* (2013.01); *E21D 20/02* (2013.01); *E21D 21/00* (2013.01); *E21D 21/006* (2016.01); *E21D 21/0026* (2013.01); *E21D 21/0053* (2016.01)

(58) Field of Classification Search

CPC ..... E21D 21/00; E21D 20/00

USPC ..... 299/11; 405/258.1, 259.1, 259.2, 259.3, 405/259.4, 259.6, 272, 288, 302.2, 259.5

See application file for complete search history.

(56) References Cited

U.S. PATENT DOCUMENTS

| | | | | |
|---|---|---|---|---|
| 2,667,037 A * | 1/1954 | Thomas | ..... | E21D 20/021 156/94 |
| 3,077,809 A * | 2/1963 | Harding | ..... | E21D 11/006 405/302.2 |

(Continued)

*Primary Examiner* — John Kreck
*Assistant Examiner* — Michael Goodwin
(74) *Attorney, Agent, or Firm* — Winstead PC

(57) ABSTRACT

The present application relates to a system for supporting a roof of a portion of a mine. The system includes a first plurality of stabilizing members disposed above the roof at a first elevation. The first plurality of stabilizing members originate from a first common location and terminate at a second elevation that is higher than the first elevation. The system further includes a second plurality of stabilizing members disposed above the roof and the first plurality of stabilizing members at a third elevation. The second plurality of stabilizing members originate from a second common location and terminate at a fourth elevation that is higher than the third elevation. The second plurality of stabilizing members are disposed generally perpendicular to the first plurality of stabilizing members.

18 Claims, 13 Drawing Sheets

(51) Int. Cl.

| | |
|---|---|
| ***E21D 20/02*** | (2006.01) |
| ***E21B 4/02*** | (2006.01) |
| ***E21B 7/06*** | (2006.01) |
| ***E21D 11/15*** | (2006.01) |
| ***E21D 11/40*** | (2006.01) |

(56) References Cited

U.S. PATENT DOCUMENTS 3,306,051 A * 2/1967 Howlett ..... E21D 20/02 285/417
3,971,226 A * 7/1976 Morrell ..... E21D 20/02 299/11
5,462,391 A * 10/1995 Castle ..... E21D 11/006 405/259.1
5,542,788 A * 8/1996 Stankus ..... E21C 41/16 33/1 H
6,120,214 A * 9/2000 Iovino ..... E02D 5/36 405/240
6,520,718 B1 * 2/2003 Nagatomo ..... E21D 9/00 299/11
2005/0158127 A1 * 7/2005 Fergusson ..... E21D 21/0026 405/259.5
2007/0051538 A1 * 3/2007 Angman ..... E21B 7/20 175/57

* cited by examiner

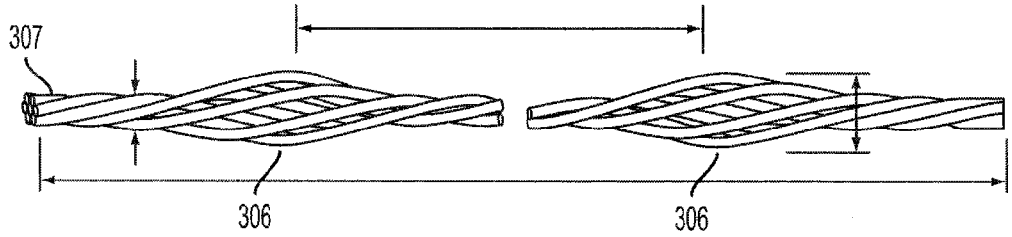

FIG. 3

402

| DIMENSIONS | 0.5" CABLE BOLT | 0.6" CABLE BOLT | 0.7" CABLE BOLT |
|---|---|---|---|
| E STRAND DIAMETER | 0.500" +0.026" -0.006"<br>12.70 mm +0.66mm -0.15mm | 0.600" +0.026" -0.006"<br>15.24 mm +0.66mm -0.15mm | 0.700" +0.028" -0.006"<br>17.78 mm +0.66mm -0.15mm |

| CONSTRUCTION DETAILS | 0.5" CABLE BOLT | 0.6" CABLE BOLT | 0.7" CABLE BOLT |
|---|---|---|---|
| CONSTRUCTION | 1 CENTER WIRE & 6 OUTER WIRES | | |
| STEEL AREA | NOM. 0.153 $in^2$ (98.7$mm^2$) | NOM. 0.217 $in^2$ (140 $mm^2$) | NOM. 0.304 $in^2$ (196 $mm^2$) |
| STANDING PITCH | 12-16x DIAMETER | | |
| WEIGHT PER 1000ft<br>WEIGHT PER 1000m | 520 lbs<br>775 kg | 740 lbs<br>1102 kg | 1110 lbs<br>1654 kg |
| DIFFERENCE IN WIRE SIZE (CENTER - OUTER) | min. 0.003" (0.076 mm) | min. 0.004" (0.102 mm) | min. 0.005" (0.127 mm) |

| PHYSICAL PROPERTIES | 0.5" CABLE BOLT | 0.6" CABLE BOLT | 0.7" CABLE BOLT |
|---|---|---|---|
| PRODUCT | UNCOATED 7 WIRE LOW RELAXATION STRAND | | |
| GRADE | 270 K - 270,000 psi (1860 MPa) ULTIMATE STRENGTH | | |
| BREAKING STRENGTH min. | 41,300 lbs (183.7 kN) | 58,600 lbs (260.7 kN) | 76,200 lbs (339 kN) |
| 1% EXTENSION UNDER LOAD, min. | 37,170 lbs (165.3 kN) | 52,740 lbs (234.6 kN) | 68,600 lbs (305.1 kN) |
| ELONGATION IN 24 INCH (610 mm) | 3.5% MINIMUM | | |
| RELAXATION AFTER 1000 HRS. | MAXIMUM 2.5% WITH INITIAL LOAD = 70% BREAKING STRENGTH<br>MAXIMUM 3.5% WITH INITIAL LOAD = 80% BREAKING STRENGTH | | |
| SPECIFICATION | ASTM A416, CSA G279-75, CSA G279-M1985 | | |

FIG. 4

1400

| ROD TYPE | OUTER DIAMTER (in.) | INNER DIAMETER (in.) | WEIGHT (LB/10 ft) | DEPTH RATING (ft) | MIN. MAKE UP TORQUE (ft-LBF) |
|---|---|---|---|---|---|
| BQ | 2.19 | 1.81 | 42.00 | 4,922 | 300 |
| NQ | 2.75 | 2.38 | 52.40 | 6,500 | 442 |
| HQ | 3.50 | 3.06 | 76.90 | 4,922 | 750 |

NOTE: STEEL GRADE IS 4130 TYPE (29,700 ksi MODULUS OF ELASTICITY)

FIG. 14

METHOD AND SYSTEM OF COAL MINE ROOF STABILIZATION

CROSS-REFERENCE TO RELATED APPLICATIONS

This application is a continuation of U.S. patent application Ser. No. 12/983,088, filed Dec. 31, 2010 (now U.S. Pat. No. 9,080,444). U.S. patent application Ser. No. 12/983,088 claims priority from U.S. Provisional Patent Application No. 61/292,066, filed Jan. 4, 2010, and titled METHOD AND SYSTEM OF COAL MINE ROOF STABILIZATION. U.S. patent application Ser. No. 12/983,088 and U.S. Provisional Patent Application No. 61/292,066 are incorporated herein by reference.

BACKGROUND

1. Technical Field

The present invention relates generally to a method of and system for stabilizing a subterranean rock formation during subterranean mining operations, and, in particular, but not by way of limitation, to coal mine roof stabilization and control.

2. History of Related Art

Mining for coal or other minerals located beneath the Earth's surface requires a variety of operational issues. In particular, the structural integrity of a subterranean mine (hereinafter referred to as a "mine") is of great concern. Longwall mining has been used to recover coal from beneath the Earth's surface for decades. Typically, longwall mining refers to a process of removing coal from along a face of coal or a stratified mineral deposit. Once the longwall is exposed, a machine may be used to shear off a portion of the face of the mineral deposit. The sheared off portion is then removed, for example, by a conveyor belt.

Due to enormous pressure that is exerted by the surrounding rock formation above a mining tunnel, it is sometimes difficult to maintain the integrity of a roof within the mining tunnel. Various systems have been developed to increase the stability of roofs within the mining tunnels. An exemplary system includes a use of a plurality of hydraulic jacks, wood supports, or steel supports secured between a floor and the roof of the mine tunnel. Typically, the plurality of hydraulic jacks are placed in a line along a face of the longwall to reduce a likelihood of a cave-in and protect around an area of the longwall face. As more of the face is removed from the longwall, the plurality of hydraulic jacks are moved closer to the face of the longwall in order to ensure stability of the roof near the face of the longwall.

In some mining efforts, as the plurality of hydraulic jacks are moved towards the face of the longwall, the portion of the roof that becomes unsupported as a result of moving the plurality of hydraulic jacks is allowed to cave-in. This area is typically behind the plurality of jacks and away from the direction of mining.

After it has been determined that enough of a coal seam has been removed, it is desirable to remove the mining equipment from the mining tunnel. In some mines, a surrounding rock formation in which the mine has been created may be weak or water saturated. Typically, weaker formations such as, for example, water-saturated sandstone do not support very well when mining tunnels are formed beneath it. In such mines, removing support structures such as, for example, the plurality of hydraulic jacks used for longwall mining, becomes very difficult and dangerous. Therefore, it would be beneficial to provide a method of and system for supporting a surrounding rock formation above support structures to facilitate removal of the support structures such as, for example, hydraulic jacks from a takedown room for a longwall mine.

SUMMARY OF THE INVENTION

In one embodiment, the present application relates to a system for supporting a roof of a portion of a mine. The system includes a first plurality of stabilizing members such as, for example cables or directionally-drilled sacrificial tooling (DDSTM) disposed above the roof at a first elevation. The first plurality of stabilizing members terminate at a second elevation. The system further includes a second plurality of stabilizing members disposed above the roof and the first plurality of stabilizing members at a third elevation. The second plurality of stabilizing members terminate at a fourth elevation. The second plurality of stabilizing members are disposed generally perpendicular to the first plurality of stabilizing members.

In another embodiment, the present application relates to a method of forming subterranean mineworkings. The method includes installing a first plurality of stabilizing members in a roof region at a first elevation. The first plurality of stabilizing members terminate at a second elevation. The method further includes installing a second plurality of stabilizing members in the roof region above the first plurality of stabilizing members at a third elevation. The second plurality of stabilizing members terminate at a fourth elevation. The second plurality of stabilizing members are disposed generally perpendicular to the first plurality of stabilizing members. The method finally includes creating a subterranean mine in a region of earth underlying the supported roof region.

BRIEF DESCRIPTION OF THE DRAWINGS

A more complete understanding of the method and system of the present invention may be obtained by reference to the following Detailed Description when taken in conjunction with the accompanying Drawings wherein:

FIG. 3 is a side view of a bulb of a cable according to an exemplary embodiment;

FIG. 4 is a table of typical cable specifications according to an exemplary embodiment;

FIG. 14 is a table of typical specification of a sacrificial drill rod of the type used in association with the roof support system of FIG. 11 or 12 according to an exemplary embodiment.

DETAILED DESCRIPTION OF ILLUSTRATIVE EMBODIMENTS OF THE INVENTION

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art.

Figure 1:
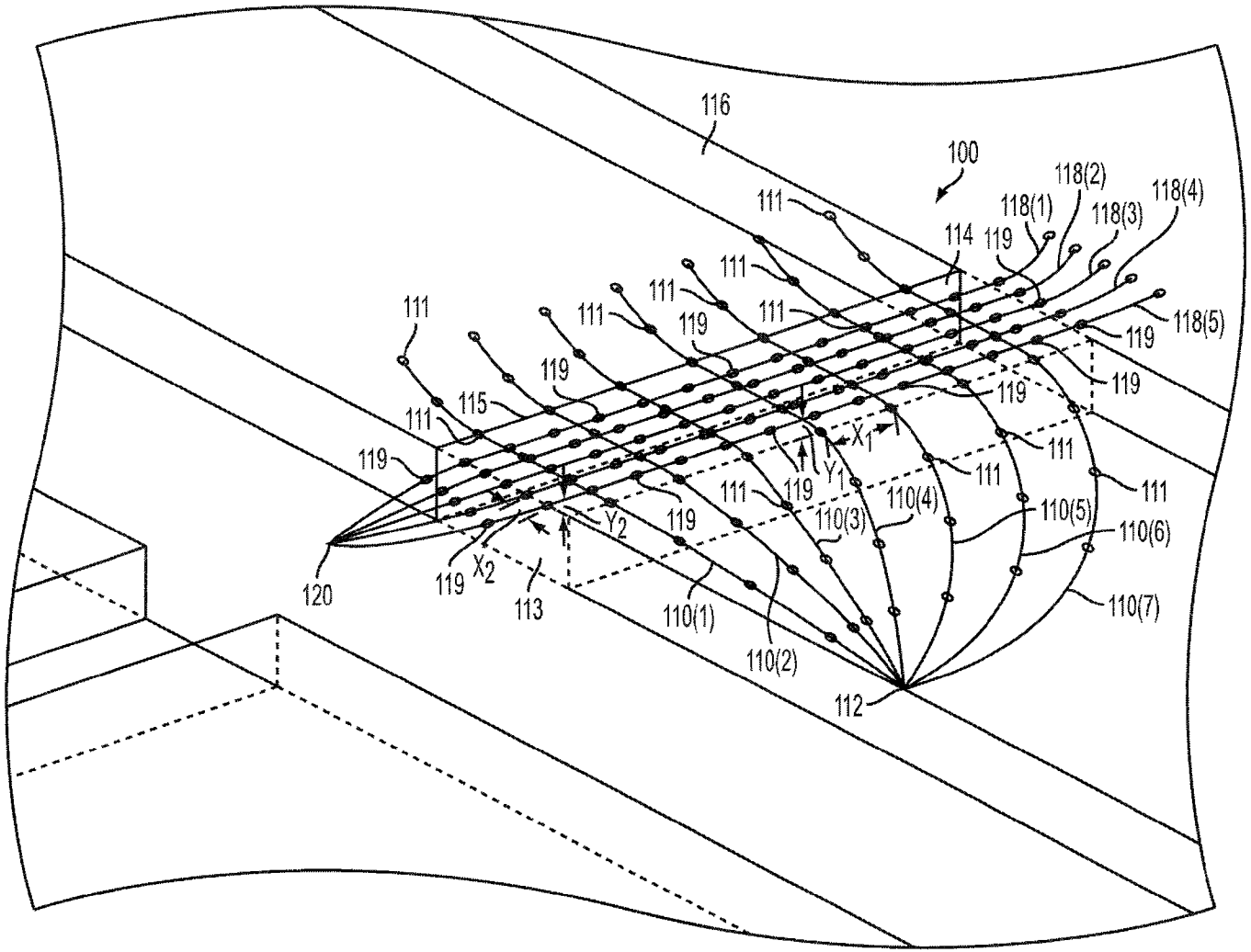
FIG. 1 is a schematic perspective view of a roof support system according to an exemplary embodiment.

FIG. 1 is a schematic perspective view of a roof support system according to an exemplary embodiment. In a typical embodiment, a roof support system 100 may be used in various types of mines having varying ground conditions, but is likely most applicable in mines having, for example, relatively soft surrounding rock formations. In addition, the roof support system 100 may be used in combination with support methods such as, for example, cribbing, meshing, roof bolts, and cable bolts. A first plurality of stabilizing members is shown originating from a common location 112. In a typical embodiment, an elevation of the first plurality of stabilizing members is dependent upon, among other things, the surrounding geological conditions. As a result, the first plurality of stabilizing members may be located at any appropriate elevation. In a typical embodiment, the first plurality of stabilizing members may be, for example a first set of cables 110 (1)-(7). In a typical embodiment, the first common location 112 may be, for example, an area of a coal mine that has already been established. The first set of cables 110 (1)-(7) is run through a first set of boreholes (not explicitly shown) that may be directionally drilled through a surrounding rock formation to a desired location.

In a typical embodiment, each of the first set of boreholes are directionally drilled to pass over a takedown room 113 and are oriented generally perpendicular to a plane 114 located on a face of a coal seam 116. In a typical embodiment, the takedown room 113 is essentially a room that is used to recover longwall mining equipment. In some cases, the takedown room 113 can be pre-mined ahead of a longwall face. The takedown room 113 is typically created by a plurality of individual shields that support a roof. In a typical embodiment, each of the first set of boreholes is located approximately 10 feet above a roof 115 of the takedown room 113. In other embodiments, the first set of boreholes may be located closer to or farther from the roof of the takedown room 113. Placement of the first set of boreholes above the takedown room 113 depends, for example, on geology of overlying strata and geomechanics of the surrounding formation. In some embodiments, the takedown room 113 may not yet exist. An end of each of the first set of boreholes (not explicitly shown) terminates past the plane 114 of the face of the coal seam 116. In a typical embodiment, each of the first set of boreholes includes a collar (not explicitly shown) that is cemented into the surrounding rock formation at a beginning portion of the first set of boreholes. The collar is typically installed prior to drilling the first set of boreholes. In a typical embodiment, the collar may be, for example, a piece of casing having, for example, a diameter of approximately 4 inches and a length of approximately 10 feet.

In a typical embodiment, each of the first set of boreholes terminates approximately at least 40 feet past the takedown room 113. Furthermore, in various embodiments, an end of each of the first set of boreholes may terminate at an elevation that is higher than a portion of the first set of boreholes that passes above the takedown room 113. For example, the first set of boreholes may pass approximately 10 feet above the takedown room 113 and have ends that terminate at an elevation of approximately 40 feet above the takedown room. However, in various embodiments, an end of each of the first set of boreholes may terminate at an elevation that is generally equal to a portion of the first set of boreholes that passes above the takedown room 113. The exact terminating elevation of the first set of boreholes is dependent, for example, upon the surrounding geology. As a result, any pre-determined terminating elevation could be used to ensure that the first set of cables 110(1)-(7) are secured into a competent rock formation.

The first set of boreholes may include any desired number of boreholes, but typically includes a sufficient number of boreholes to span a width of the face of the coal seam 116 while maintaining a reasonable spacing, such as, for example, approximately 75 feet between each of the first set of boreholes. In a typical embodiment, each of the first set of boreholes is generally equally spaced from adjacent boreholes; however, design considerations could alter the spacing between of each of the first set of boreholes. In a typical embodiment, each of the first set of cables 110(1)-(7) is installed upon completion of its corresponding borehole. However, depending on stability of the formation, each of the first set of cables 110(1)-(7) may be installed after some or all of the first set of boreholes have been completed.

In various embodiments, each of the first set of cables 110(1)-(7) may include a series of bulbs 111 spaced at, for example, approximately 5 foot intervals along a length of each of the first set of cables 110(1)-(7). The series of bulbs are illustrated in FIG. 4 and will be discussed in more detail below. The series of bulbs 111 are represented in FIG. 1 by small circles on each of the first set of cables 110 (1)-(7). The spacing of the series of bulbs 111 may be varied depending on design considerations. In order to secure each of the first set of cables 110 (1)-(7) within its respective boreholes, a solution such as, for example, grout, may be pumped into each of the first set of boreholes. As the grout hardens, each of the first set of cables 110(1)-(7) becomes set within its corresponding borehole. This process will be described in more detail below. The series of bulbs 111, which become surrounded by the grout, provide a greater contact surface between the grout and the first set of cables 110(1)-(7), thereby further securing each of the first set of cables 110(1)-(7) within the first set of boreholes.

Still referring to FIG. 1, in a typical embodiment, a second set of cables 118 (1)-(5) originates from a second common point 120. The second common point 120 may be, for example, another area of the coal mine that has already been established. The second set of cables 118 (1)-(5) is run through a second set of boreholes (not explicitly shown) that may be directionally drilled to a desired location. In a typical embodiment, the second set of boreholes is drilled generally perpendicular to the first set of boreholes and passes above the takedown room 113 along the width of the coal seam 116. In a typical embodiment, the second set of boreholes is drilled at a height of approximately 15feet above the roof 115 of the takedown room 113, which is approximately 5feet above the first set of boreholes. Each of the second set of boreholes spans the width of the face of the coal seam 116 and may, in various embodiment, terminate at an end that is approximately 40feet higher than a portion that spans the takedown room 113. However, in various embodiments, an end of each of the second set of boreholes may terminate at an elevation that is generally equal to a portion of the second set of boreholes that passes above the takedown room 113. The exact terminating elevation of the second set of boreholes is dependent, for example, upon the surrounding geology. As a result, any pre-determined terminating elevation could be used to ensure that the second set of cables 118(1)-(5) are secured into a competent rock formation.

In a typical embodiment, each of the second set of boreholes includes a collar (not explicitly shown) that is cemented into the surrounding rock formation at a beginning portion of the second set of boreholes. The collar may be, for example, a section of casing having a diameter of approximately 4 inches and a length of approximately 10 feet.

In some embodiments, the second set of boreholes are spaced, relative to the first set of boreholes, closer together. For example, the second set of boreholes may be spaced approximately 7.5 feet apart. After the second set of boreholes has been drilled, the second set of cables 118 (1)-(5) may be run through the second set of boreholes. The first set of cables 110 (1)-(7) has been illustrated by way of example in FIG. 1 as including seven cables 110 (1)-(7); however, one skilled in the art will understand that any number of cables could be used. Likewise, the second set of cables 118 (1)-(5) has been illustrated by way of example in FIG. 1 as including five cables 118 (1)-(5); however, one skilled in the art will understand that any number of cables could be used. In a typical embodiment, the exact number of cables to be used depends on factors such as, for example, the geomechanics and geology of the surrounding rock formation.

In a various embodiments, each of the second set of cables 118 (1)-(5) may include a series of bulbs 119 spaced at approximately 5 foot intervals along a length of each of the second set of cables 118 (1)-(5). The series of bulbs 119 are represented in FIG. 1 by small circles on each of the second set of cables 118 (1)-(5). In order to secure each of the second set of cables 118 (1)-(5) within its respective borehole, a solution such as, for example, grout, may be pumped into each of the second set of boreholes. As the grout hardens, each of the second set of cables 118 (1)-(5) becomes set within its corresponding borehole. The series of bulbs 119, which are surrounded by grout, provide a greater contact surface within the grout and the second set of cables 118(1)-(5), thereby further securing each of the second set of cables 118 (1)-(5) within the second set of boreholes.

Still referring to FIG. 1, the first set of cables 110(1)-(7) and second set of cables 118(1)-(5) form the roof support system 100. In a typical embodiment, the roof support system 100 maintains integrity of the roof 115 of the takedown room 113 by distributing the weight of the roof 115 to the first and second set of cables 110(1)-(7) and 118(1)-(5) and to the surrounding rock formation. With the roof support system 100 in place, the roof 115 of the takedown room 113 no longer needs to support all of the surrounding rock formation above it. Instead, the roof 115 of the takedown room 113 only needs to support a portion of the surrounding rock formation. Now that the roof 115 of the takedown room 113 is not required to support the entire weight of the surrounding rock formation above the roof, it is more likely that the roof 115 may support its own weight, thereby making it possible to remove a support system such as, for example, a series of hydraulic jacks, from the takedown room 113.

Figure 2:
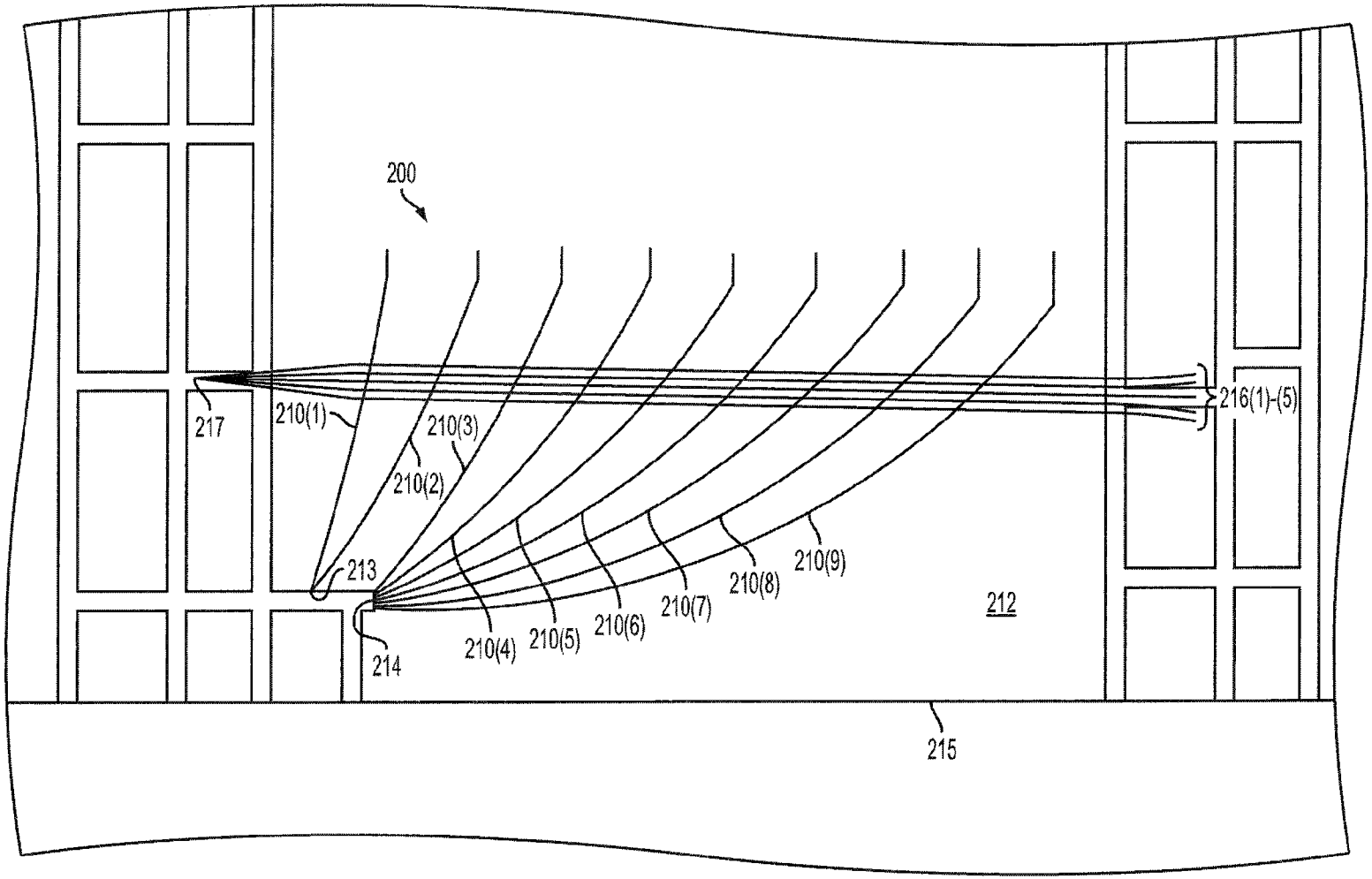
FIG. 2 is a schematic top view of a roof support system according to an exemplary embodiment.

FIG. 2 is a schematic top view of a roof support system 200 according to an exemplary embodiment. In an exemplary embodiment, the roof support system 200 includes a first set of boreholes 210 (1)-(9). The first set of boreholes 210(1)-(9) consists of, for example, 9 boreholes directionally drilled through a surrounding rock formation 212 to pass approximately 10 feet above a takedown room 215. In some embodiments, the number of boreholes and the height of the boreholes above the takedown room may be varied as desired. As discussed above with respect to FIG. 1, each borehole typically includes a collar that facilitates drilling of the borehole. In various embodiments, a first borehole 210(1) and a second borehole 210(2) are directionally drilled from a first location 213 while boreholes 210(3)-(9) are drilled from a second location 214. In a typical embodiment, a point of origin for each of the first set of boreholes 210(1)-(9) is a matter of design preference. In a typical embodiment, the first set of boreholes 210(1)-(9) pass over a takedown room at various angles. Such an arrangement is in contrast to the embodiment shown in FIG. 1 where each of the first set of boreholes (not explicitly shown) passes over the takedown room 113 (shown in FIG. 1) with a direction generally perpendicular to a face of the coal seam 116. In some embodiments, it may be preferable to drill the first set of boreholes 210(1)-(9) as shown in FIG. 2, as it allows for shorter boreholes to be drilled.

Still referring to FIG. 2, according to an exemplary embodiment, a second set of boreholes 216(1)-(5) is shown having 5 boreholes originating from a third location 217. As discussed above with respect to the first set of boreholes 210(1)-(9), the point of origin for each of the second set of boreholes 216(1)-(5) is a matter of design preference. In alternative embodiments, the number of boreholes may be varied as desired. In a typical embodiment, each of the second set of boreholes 216(1)-(5) passes over the takedown room 215 and terminates past the takedown room 113. In a typical embodiment, the second set of boreholes are directionally drilled to pass approximately 5 feet above the first set of boreholes 210(1)-(9).

In a typical embodiment, after the first and second sets of boreholes have been completed, a stabilizing member such as, for example, one of the first or second sets of cables 110 (1)-(7) or 118 (1)-(5) (shown in FIG. 1), may be run through each of the first set of boreholes 210(1)-(9) and second set of boreholes 216(1)-(5) and grouted in place as discussed above. In various embodiments, each of the cables may include a series of bulbs 306 with each bulb spaced approximately 5 feet apart. In various embodiments, the bulb spacing may be varied.

FIG. 3 is a side view of a bulb of a cable according to an exemplary embodiment. In a typical embodiment, a bulb 306 is operable to increase contact between a cable 307 and grout to further secure the cable 307 within a borehole. In various embodiments, a diameter of the cable 307 and the bulbs 306 may be varied according to design requirements.

FIG. 4 is a table of typical cable specifications according to an exemplary embodiment. In FIG. 4, a table 402 includes examples of specifications that may be used with a cable such as, for example, the cable 307 (shown in FIG. 3). In various embodiments, other cables could, however, be used where appropriate. As shown in the table 402, in various embodiments, a typical cable may have a diameter between about 0.5 inches and about 0.7 inches. In various embodiments, a typical cable may have a weight per 1000 feet of between about 520 lbs and about 1110 lbs. Finally, in various embodiments, a typical cable may have a breaking strength between about 37,000 lbs and about 76,000 lbs in tension.

Figure 5:
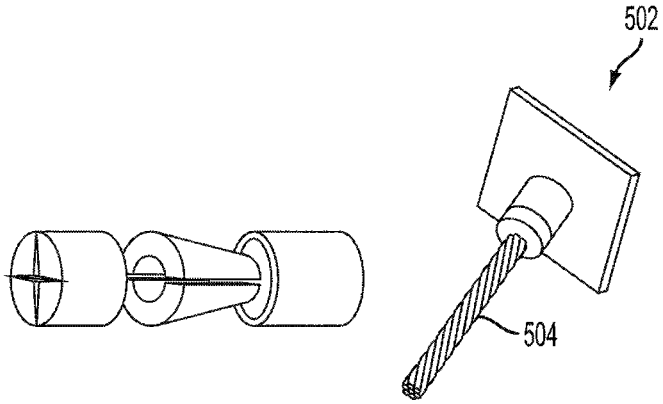
FIG. 5 is a perspective view of a fastener plate assembly according to an exemplary embodiment.

FIG. 5 is a perspective view of a fastener plate assembly 502 according to an exemplary embodiment. In a typical embodiment, the fastener plate assembly 502 is operable to allow a cable 504 to be pre-tensioned to a set amount. Pre-tensioning of the cable 504 enables the cable 504 to function as, for example, an active support structure applying a forward load to the strata in the roof 115 (shown in FIG. 1).

Figure 6:
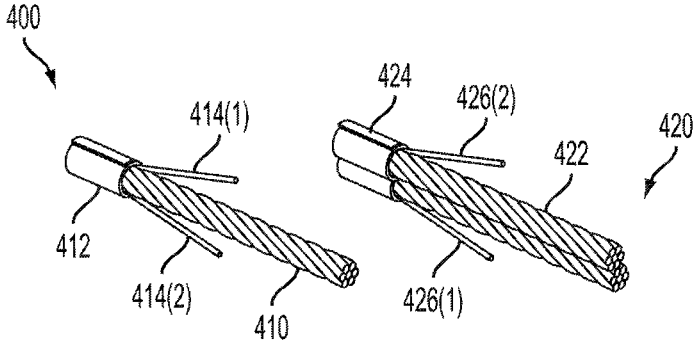
FIG. 6 is a perspective view of two embodiments of a cable fish hook end cap according to an exemplary embodiment.

FIG. 6 is a perspective view of two embodiments of a cable fish hook end cap. An exemplary single cable fish hook 400 includes a single cable 410 and a single cable end cap 412. The end cap includes a pair of barbs 414(1)-(2) that stick out away from the cable 410 and are oriented generally away from the endcap 412. In a typical embodiment, the barbs 414(1)-(2) are formed such that, if compressed towards the cable 410, the barbs 414 (1)-(2) tend to spring back to the position illustrated. In various embodiments, the single cable fish hook 400 may be disposed on an end of the cable 410 to facilitate installation of the cable 410 into a borehole. In some embodiments, it may be desirable to use a pair of cables 422. In such embodiments, a double cable fish hook 420 may be used. The exemplary double cable fish hook 420 includes a pair of cables that include a double cable end cap 424. In a typical embodiment, the double cable end cap 424 includes a pair of barbs 426(1)-(2) that stick out away from the pair of cables 422 and are oriented generally away from the double cable end cap 424.

Figure 7B:
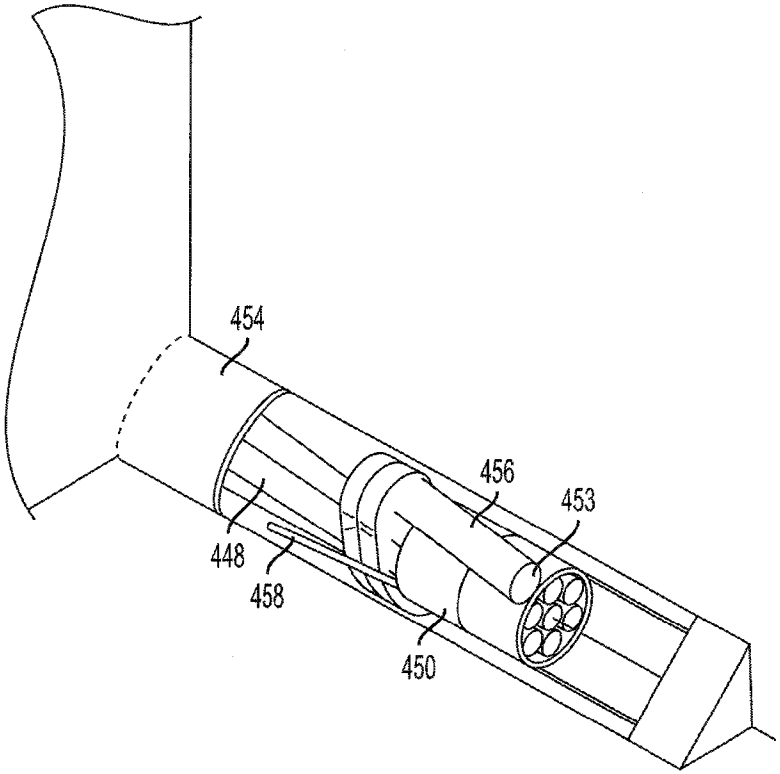
FIGS. 7A-7B are perspective views depicting injection of grout into a borehole for securing a cable in the borehole.
Figure 7A:
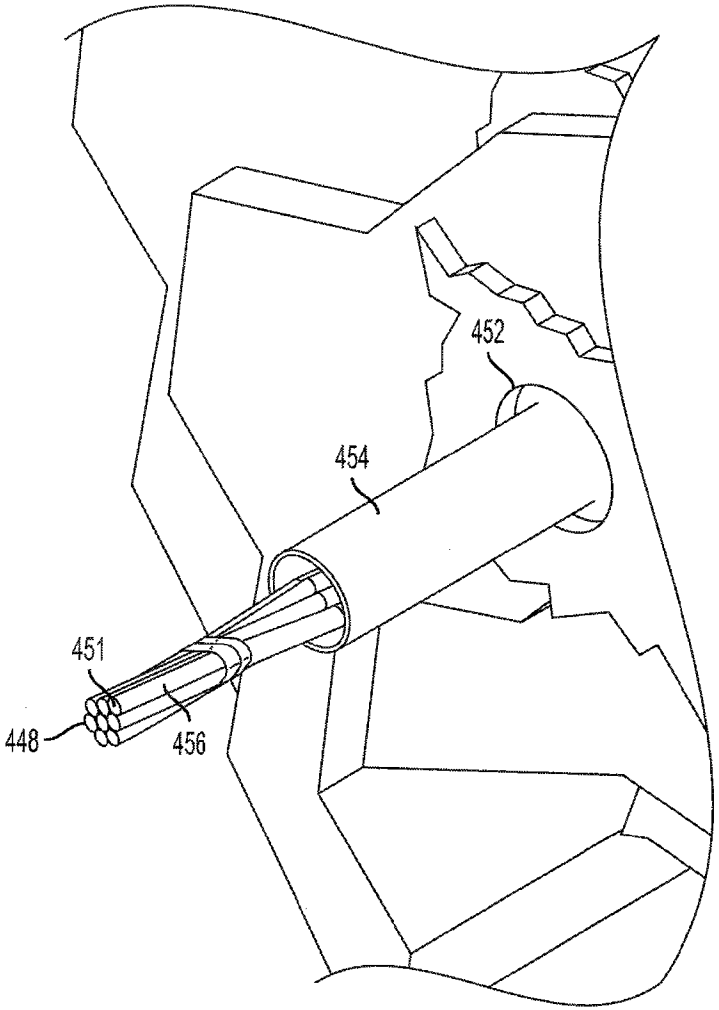

FIGS. 7A and 7B are perspective views depicting injection of grout into a borehole 452 according to an exemplary embodiment. In a typical embodiment, a cable 448 using either a single strand fish hook or a double strand fish hook (illustrated in FIG. 6) may be inserted into the borehole 452 and secured therein. A hollow drill rod 454 is shown inserted into the borehole 452. In a typical embodiment, the hollow drill rod 454 is not inserted all the way into the borehole 452. Instead, the hollow drill rod 454 is inserted so that a few feet of the borehole remains. After the hollow drill rod 454 has been inserted into the borehole 452, the cable 448, which has attached to it a single strand fish hook 450 and a breather tube 456, may be fed through the hollow drill rod 454, which has a relatively smooth internal surface that facilitates the passage of the cable 448. Once the cable 448 reaches the end of the hollow drill rod 454 and enters into an end of the borehole, barbs 458, which were slightly compressed within the hollow drill rod 454, expand and press against an interior wall of the borehole. With the barbs 458 pressed against the interior wall of the borehole 452, a force that would otherwise remove the cable from the borehole 452 instead causes the barbs 458 to be driven farther into the borehole 452. With the barbs 458 pressing against the interior of the borehole 452, the hollow drill rod 454 may be removed from the borehole 452 without also removing the cable 448, which is anchored to the borehole 452 by the barbs 458.

Still referring to FIGS. 7A and 7B, in order to facilitate injection of grout into the borehole 452 to secure the cable 448 in the borehole 452, the breather tube 456 may be secured to the cable 448. In a typical embodiment, a first end 451 of the breather tube 456 remains exposed at an entrance to the borehole 452. A second end 453 of the breather tube 456 is secured to the end of the cable so that it reaches the end of the borehole 452. The breather tube 456 may be, for example, approximately ½ inch or approximately ¾ inch poly plastic line. After the hollow drill rod 454 has been removed, grout may be pumped under high pressure into an annulus of the borehole 452 around the cable and breather tube 456. As the grout begins to fill the borehole 452, air is forced through the breather tube 456. After grout has reached the end of the borehole 452, grout begins to flow into the second end of the breather tube 456. Once the grout begins to come out of the first end 453 of the breather tube 456, it is apparent that the borehole 452 has been filled with grout and the pumping process is complete.

Figure 8:
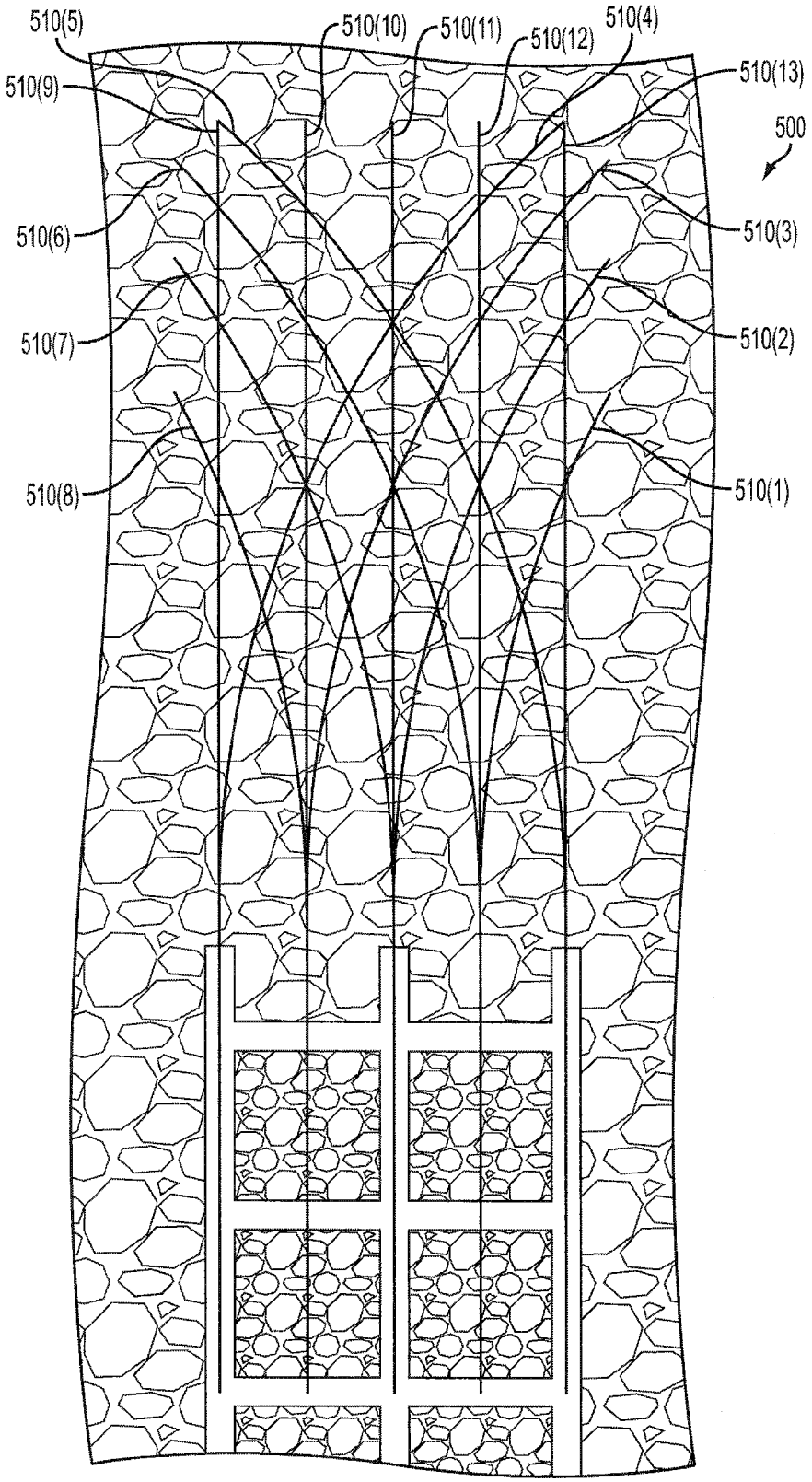
FIG. 8 is a top view of a roof support system according to another exemplary embodiment.

FIG. 8 is a top view of a roof support system according to another exemplary embodiment. In a typical embodiment, a roof support system 500 includes a set of boreholes 510 (1)-(13). In a typical embodiment, the set of boreholes 510(1)-(13) are drilled in a non-intersecting inter-layered fan pattern. In this embodiment, the non-intersecting inter-layered fan pattern is typically placed in advance of mine tunnels in order to support a surrounding rock formation in advance of multiple excavations. Similar to the embodiments described above, each of the set of boreholes 510(1)-(13) terminates at a higher elevation than a portion of the borehole passing above the tunnels.

Figure 9:
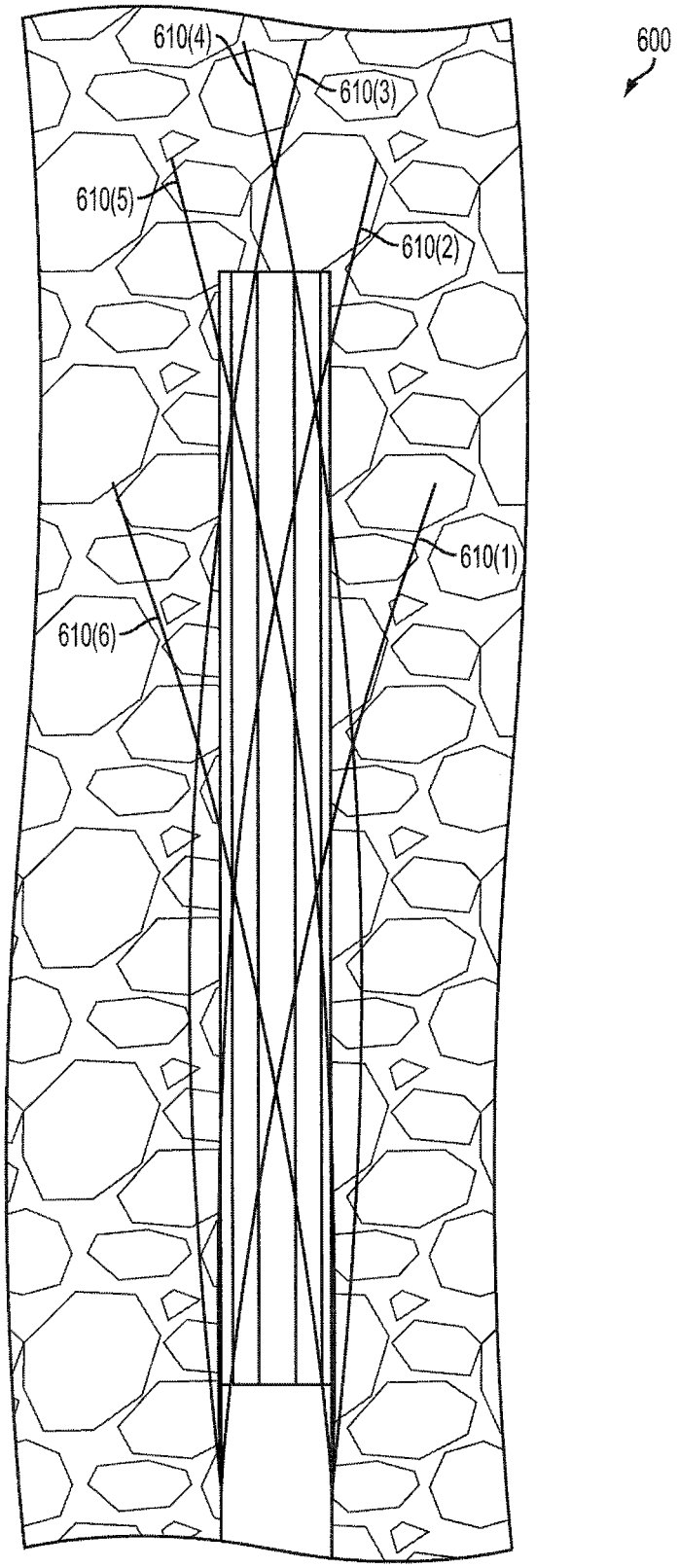
FIG. 9 is a top view of a roof support system according to another exemplary embodiment.

FIG. 9 is a top view of a roof support system according to another exemplary embodiment. In a typical embodiment a roof support system 600 includes a set of boreholes 610 (1)-(6). In a typical embodiment, the set of boreholes 610(1)-(6) are drilled in a narrow-fan arrangement. In this embodiment, the narrow-fan arrangement is typically placed above a single mine entry or a tunnel in order to support a surrounding rock formation in advance of mining or tunneling. Similar to the embodiments described above, each of set of boreholes 610(1)-(6) terminates at a higher elevation than a portion of the borehole passing above the excavations.

Figure 10:
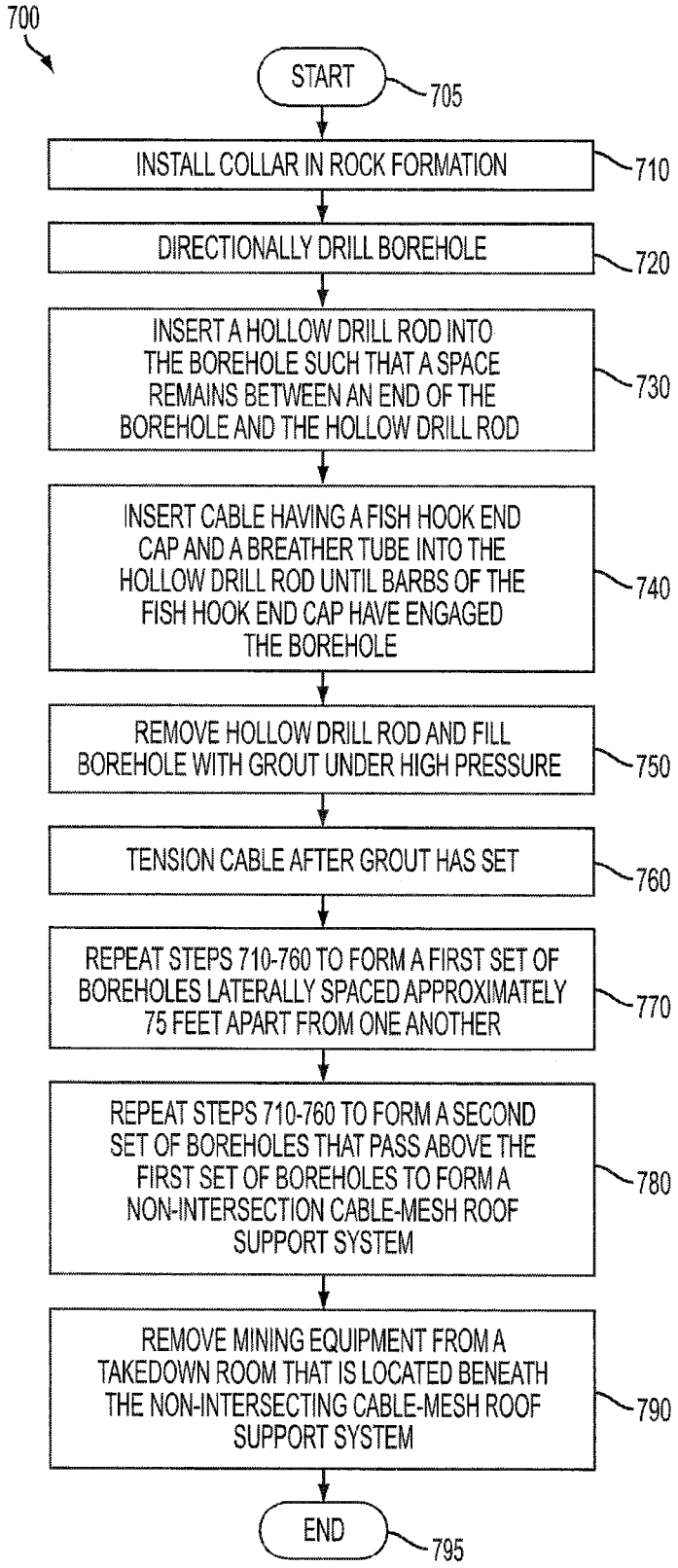
FIG. 10 is a flowchart of a process for installing a roof support system according to an exemplary embodiment.

Referring now to FIG. 10, a flowchart of a process 700 for installing a roof support system is shown. The process 700 begins at step 705. At step 710, a collar is installed into a rock face at a location where a borehole will be drilled. The collar facilitates use of drilling equipment to drill the borehole. At step 720, the borehole is directionally drilled such that a portion of the borehole passes generally perpendicular to and approximately 10feet above a face of a coal seam. At step 730, a hollow drill rod is inserted into the borehole such that a space remains between an end of the borehole and an end of the hollow drill rod. At step 740, a cable having a fish hook end cap and a breather tube is inserted into the hollow drill rod until the fish hook end cap enters the space and barbs of the fish hook end cap engage the borehole. At step 750, the hollow drill rod is removed and the borehole is filled with grout under high pressure until the borehole is full. At step 760, the cable is tensioned after the grout has set. At step 770, steps 710-760 are repeated at additional locations to form a first set of boreholes that spans the length of the coal seam face such that each borehole passes over the face of the coal seam in a generally perpendicular direction and such that each borehole is laterally spaced about 75 feet from neighboring boreholes. At step 780, steps 710-760 are performed at new locations to create a second set of boreholes that cross over the first set of boreholes to form the cable roof support system. Each of the second set of boreholes passes over the face of the coal seam at a height that is approximately 5 feet above the first set of boreholes. At step 790, mining equipment is removed from a takedown room that is located beneath the cable roof support system. At step 795, the process 700 ends.

Figure 11:
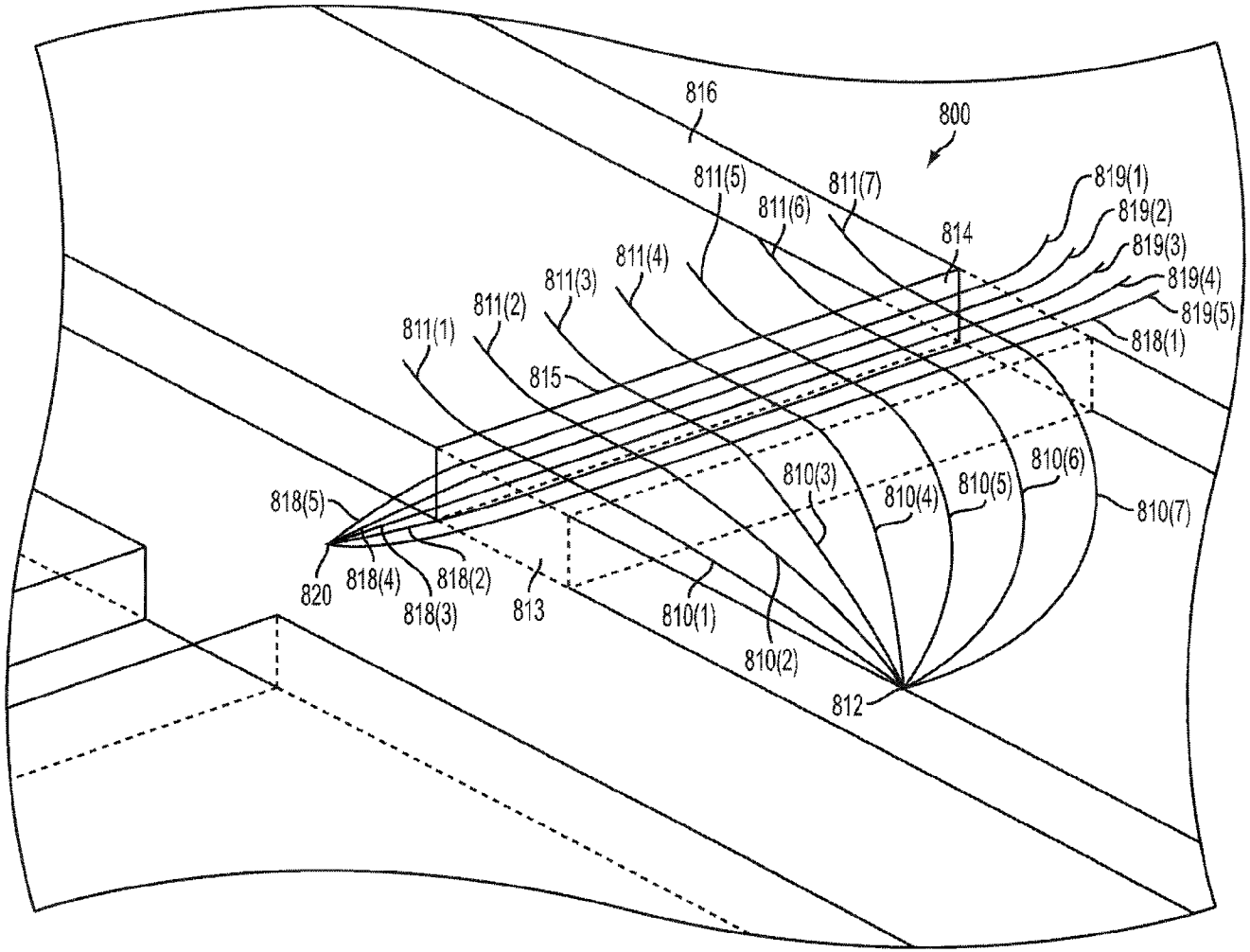
FIG. 11 is a schematic perspective view of a roof support system according to another exemplary embodiment.

FIG. 11 is a schematic perspective view of a roof support system according to another exemplary embodiment. In a typical embodiment, the roof support system 800 utilizes directionally-drilled sacrificial tooling (DDSTM). In contrast to the embodiment described in FIG. 1, the roof support system 800 utilizes sacrificial drill rods which are first used to create boreholes and then left in place as a roof support structure. Use of DDSTM eliminates the need for a separate operation of securing stabilizing members within previously drilled boreholes. In a typical embodiment, a mode of support associated with the roof support system 800 differs from the roof support system 100 illustrated in FIG. 1. In the roof support system 800, sacrificial drill rods act as beam members that are capable of supporting bending; however, due to the joints between drill rod lengths, the sacrificial drill rods do not support the same level of tension as cables. Thus, the roof support system 800 is best suited for use in soft ground without a competent anchor stratum. In addition, the roof support system 800 may be used in combination with support methods such as, for example, cribbing, meshing, roof bolts, and cable bolts.

Still referring to FIG. 11, in a typical embodiment, the support system 800 may be used in various types of mines, but is likely most applicable in mines having, for example, relatively soft surrounding rock formations or mines where a competent anchor stratum cannot be reached with conventional means such as, for example, roof bolts. In a typical embodiment, a first set of sacrificial drill rods 810 (1)-(7) is shown originating from a first common location 812. In a typical embodiment, the first common location 812 may be, for example, an area of a coal mine that has already been established. In a typical embodiment, an elevation of the first set of sacrificial drill rods 810(1)-(7) is dependent upon, among other things, the surrounding geological conditions. As a result, the first set of sacrificial drill rods may be located at any appropriate elevation. In a typical embodiment, each of the sacrificial drill rods 810(1)-(7) comprise a directional drilling motor 811(1)-(7) affixed to an end. In a typical embodiment, the directional drilling motors 811(1)-(7) are utilized in combination with the first set of sacrificial drill rods 810(1)-(7) to create a first set of boreholes (not explicitly shown) that may be directionally drilled through a surrounding rock formation to a desired location.

In a typical embodiment, each of the first set of boreholes are directionally drilled to pass over a takedown room 813 and are oriented generally perpendicular to a plane 814 located on a face of a coal seam 816. In a typical embodiment, the takedown room 813 is essentially a room that is used to recover longwall mining equipment. The takedown room 813 is typically created by a plurality of individual shields that support the roof. In a typical embodiment, the takedown room 813 may be pre-mined or ahead of a longwall face advance. In a typical embodiment, each of the boreholes is located approximately 10 feet above a roof 815 of the takedown room 813. In other embodiments, the boreholes may be located closer to or farther from the roof 815 of the takedown room 813. Placement of the boreholes above the takedown room 813 depends, for example, on geology of overlying strata and geomechanics of the surrounding formation. In some embodiments, the takedown room 813 may not yet exist. An end of each of the first set of boreholes (not explicitly shown) terminates past the plane 814 of the face of the coal seam 816. In a typical embodiment, each of the first set of boreholes includes a collar (not explicitly shown) that is cemented into the surrounding rock formation at a beginning portion of the borehole. The collar is typically installed prior to drilling the borehole. In a typical embodiment, the collar may be, for example, a piece of casing having, for example, a diameter of approximately 4 inches and a length of approximately 10 feet.

In a typical embodiment, each of the first set of boreholes terminates approximately at least 40 feet past the take takedown room 813. Furthermore, in various embodiments, an end of each of the first set of boreholes may terminate at an elevation that is higher than a portion of the first set of boreholes that passes above the takedown room 813. For example, the first set of boreholes may pass approximately 10 feet above the takedown room 813 and have ends that terminate at an elevation of approximately 40 feet above the takedown room. However, in various embodiments, an end of each of the first set of boreholes may terminate at an elevation that is generally equal to a portion of the first set of boreholes that passes above the takedown room 813. The exact terminating elevation of the first set of boreholes is dependent, for example, upon the surrounding geology. As a result, any terminating elevation could be used to ensure that the first set of sacrificial drill rods 810(1)-(7), having the directional drilling motors 811(1)-(7) affixed to an end, are secured into a competent rock formation.

The first set of boreholes may include any desired number of boreholes, but typically includes a sufficient number of boreholes to span a width of the face of the coal seam 116 while maintaining a reasonable spacing, such as, for example, approximately 75 feet between each of the first set of boreholes. In a typical embodiment, each of the first set of boreholes is generally equally spaced from adjacent boreholes; however, design considerations could alter the spacing between of each of the first set of boreholes. In a typical embodiment, the process of drilling the first set for boreholes places both the first set of sacrificial drill rods 810(1)-(7) and the directional drilling motors 811(1)-(7) there within.

In order to secure each of the first set of sacrificial drill rods 810(1)-(7) within its respective borehole, a solution such as, for example, grout, may be pumped into each of the first set of boreholes. As the grout hardens, each of the first set of sacrificial drill rods 810(1)-(7) and the directional drilling motors 811(1)-(7) become set within each of the first set of boreholes. This process will be described in more detail below.

Still referring to FIG. 11, in a typical embodiment, a second set of sacrificial drill rods 818(1)-(5) is shown originating from a second common point 820. The second common point 820 may be, for example, another area of the coal mine that has already been established. In a typical embodiment, each of the second set of sacrificial drill rods 818(1)-(5) includes a directional drilling motor 819(1)-(5) affixed to an end. The directional drilling motor 819(1)-(5) is utilized in combination with the second set of sacrificial drill rods 818(1)-(5) to create a second set of boreholes (not explicitly shown) that may be directionally drilled to a desired location.

In a typical embodiment, the second set of boreholes is drilled generally perpendicular to the first set of boreholes and passes above the takedown room 813 along the width of the coal seam 816. In a typical embodiment, the second set of boreholes is drilled at height of approximately 15 feet above the roof the takedown room 813, which is approximately 5 feet above the first set of boreholes. Each of the second set of boreholes spans the width of the face of the coal seam 816 and may, in various embodiment, terminate at an end that is approximately 40 feet higher than a portion that spans the takedown room 813. However, in various embodiments, an end of each of the second set of boreholes may terminate at an elevation that is generally equal to a portion of the second set of boreholes that passes above the takedown room 813. The exact terminating elevation of the second set of boreholes is dependent, for example, upon the surrounding geology. As a result, any terminating elevation could be used to ensure that the second set of sacrificial drill rods 818(1)-(5), having the directional drilling motors 819 (1)-(5) affixed to an end, are secured into a competent rock formation.

In a typical embodiment, each of the second set of boreholes includes a collar (not shown) that is cemented into the surrounding rock formation at a beginning portion of the second set of boreholes. The collar may be, for example, a section of casing having a diameter of approximately 4 inches and a length of approximately 10 feet.

In some embodiments, the second set of boreholes are spaced, relative to the first set of boreholes, closer together. For example, the second set of boreholes may be spaced approximately 7.5 feet apart. In a typical embodiment, the process of drilling the second set for boreholes places both the first set of sacrificial drill rods 818 (1)-(5) and the directional drilling motors 819 (1)-(5) there within. In order to secure each of the second set of sacrificial drill rods 818 (1)-(5) within its respective borehole, a solution such as, for example, grout, may be pumped into each of the second set of boreholes. As the grout hardens, each of the second set of sacrificial drill rods 818 (1)-(5) and the directional drilling motors 819 (1)-(5) become set within the second set of boreholes.

Still referring to FIG. 11, the first set of sacrificial drill rods 810(1)-(7) and second set of sacrificial drill rods 818(1)-(5) form the roof support system 800. With the roof support system 800 in place, the roof of the takedown room 813 no longer needs to support all of the surrounding rock formation above it. Instead, the roof of the takedown room 813 only needs to support a portion of the surrounding rock formation. Now that the roof of the takedown room 813 is not required to support the entire weight of the surrounding rock formation above the roof, it is more likely that the roof may support its own weight, thereby making it possible to remove a support system such as, for example, a series of hydraulic jacks, from the takedown room 813.

Figure 12:
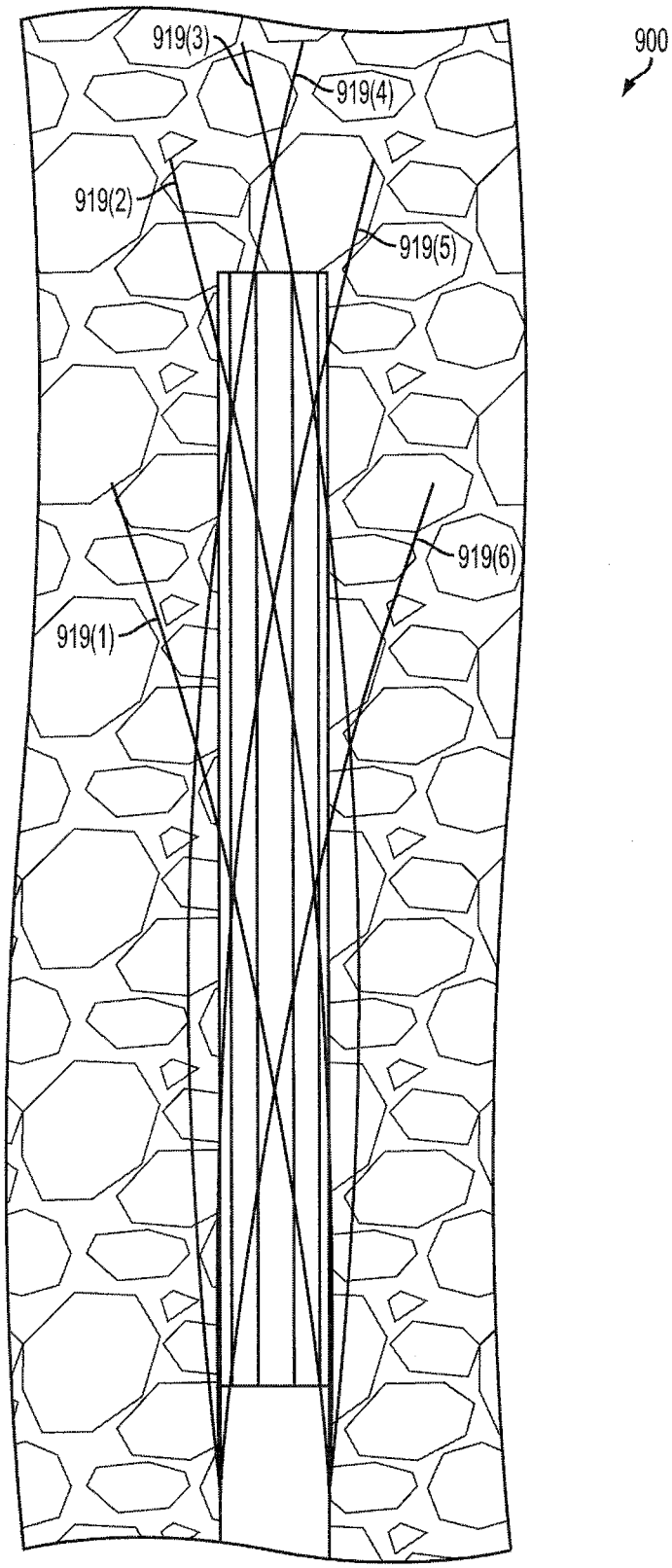
FIG. 12 is a top view of a roof support system according to an another exemplary embodiment.

Referring now to FIG. 12, an alternative embodiment of a roof support system 900 is shown. In contrast to the embodiment described in FIG. 9, the roof support system 900 utilizes DDSTM in which sacrificial drill rods which are first used to create boreholes and then left in place as a roof support structure. In the embodiment of FIG. 12, a set of sacrificial drill rods 910(1)-(6) are shown drilled in a non-intersecting inter-layered fan pattern. In this embodiment, the non-intersecting inter-layered fan pattern is typically placed in advance of mine tunnels in order to support a surrounding rock formation in advance of multiple excavations. Similar to the embodiments described above, each of the set of sacrificial drill rods 910(1)-(6) terminate at a higher elevation than a portion of the borehole passing above the tunnels.

Figure 13:
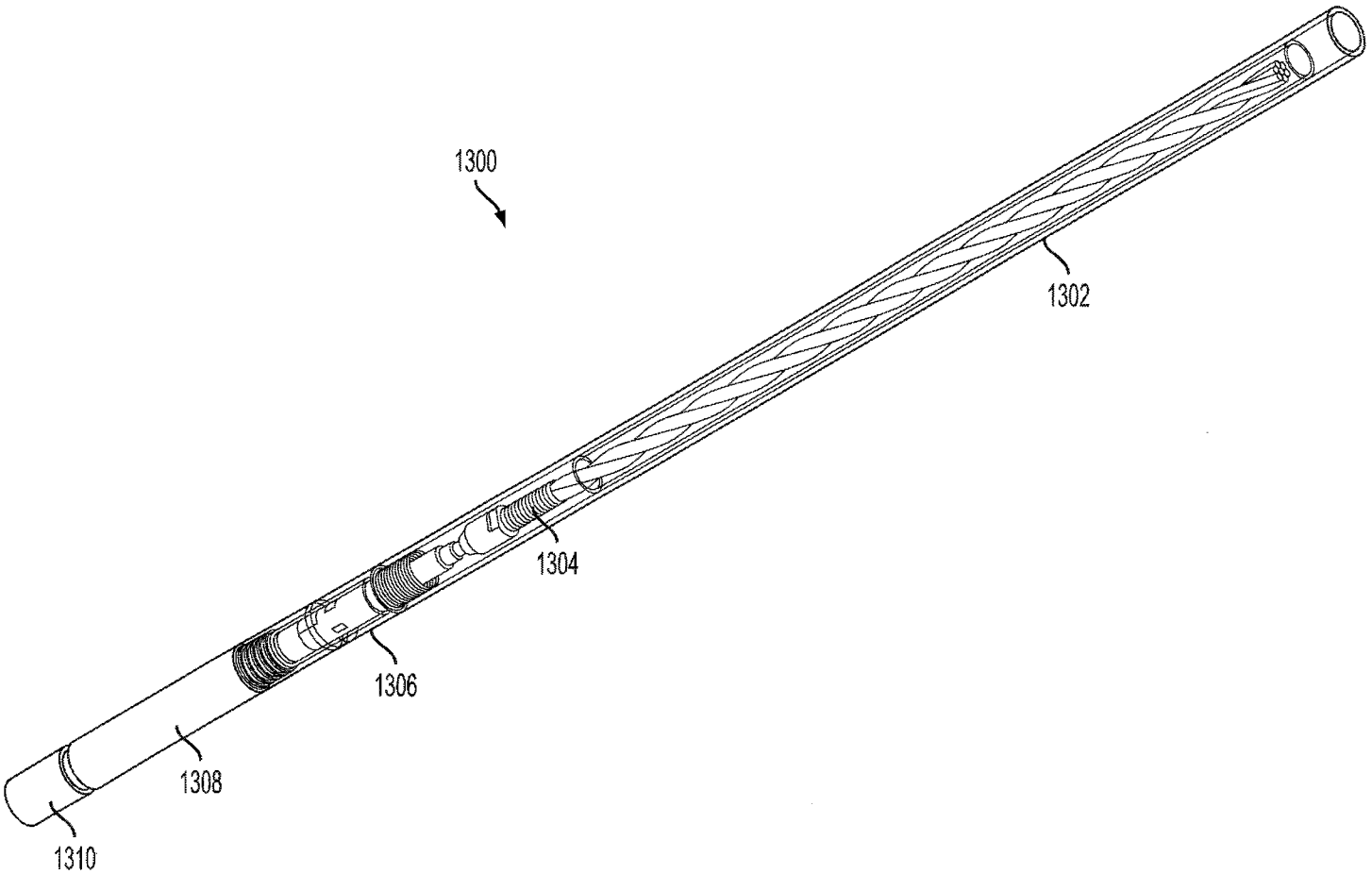
FIG. 13 is a schematic diagram of a typical sacrificial downhole motor of the type used in association with the roof support system of FIG. 11 or 12 according to an exemplary embodiment.

Referring now to FIG. 13, there is shown a schematic diagram of a sacrificial downhole drilling motor. In a typical embodiment, a sacrificial downhole drilling motor 1300 includes, for example, a disposable power section 1302, a disposable U-joint 1304, a housing 1306, and a disposable bearing assembly 1308. In a typical embodiment, the disposable power section 1302 provides power to the sacrificial downhole drilling motor 1300. In a typical embodiment, the disposable power section 1302 generates rotational mechanical energy via a fluid pumped through the disposable power section 1302 under high pressure. A working fluid such as, for example, water or drilling mud is pumped through, and out an end of, the sacrificial downhole motor 1300 at a bit 1310. In various other embodiments, the disposable power section 1302 may use other types of power such as, for example, electrical. In a typical embodiment, the disposable U-joint 1304 and the housing 1306 are capable of articulating with respect to each other and with respect to the disposable power section 1302. Such articulation allows the sacrificial downhole drilling motor 1300 to be capable of directional drilling. In a typical embodiment, the sacrificial downhole drilling motor 1300 is designed to be embedded in a subterranean formation such as, for example, a roof of a mine, and left in place.

Referring now to FIG. 14, there is shown a table of specifications of typical sacrificial drill rods. As shown in table 1400, in various embodiments, a typical sacrificial drill rod may have an outer diameter between about 2 inches and about 3.5 inches, an inner diameter between about 1.8 inches and about 3.1 inches. In addition, in various embodiments, a typical sacrificial drill rod may have a weight per 10 feet of between 42 lbs and about 77 lbs.

Figure 15:
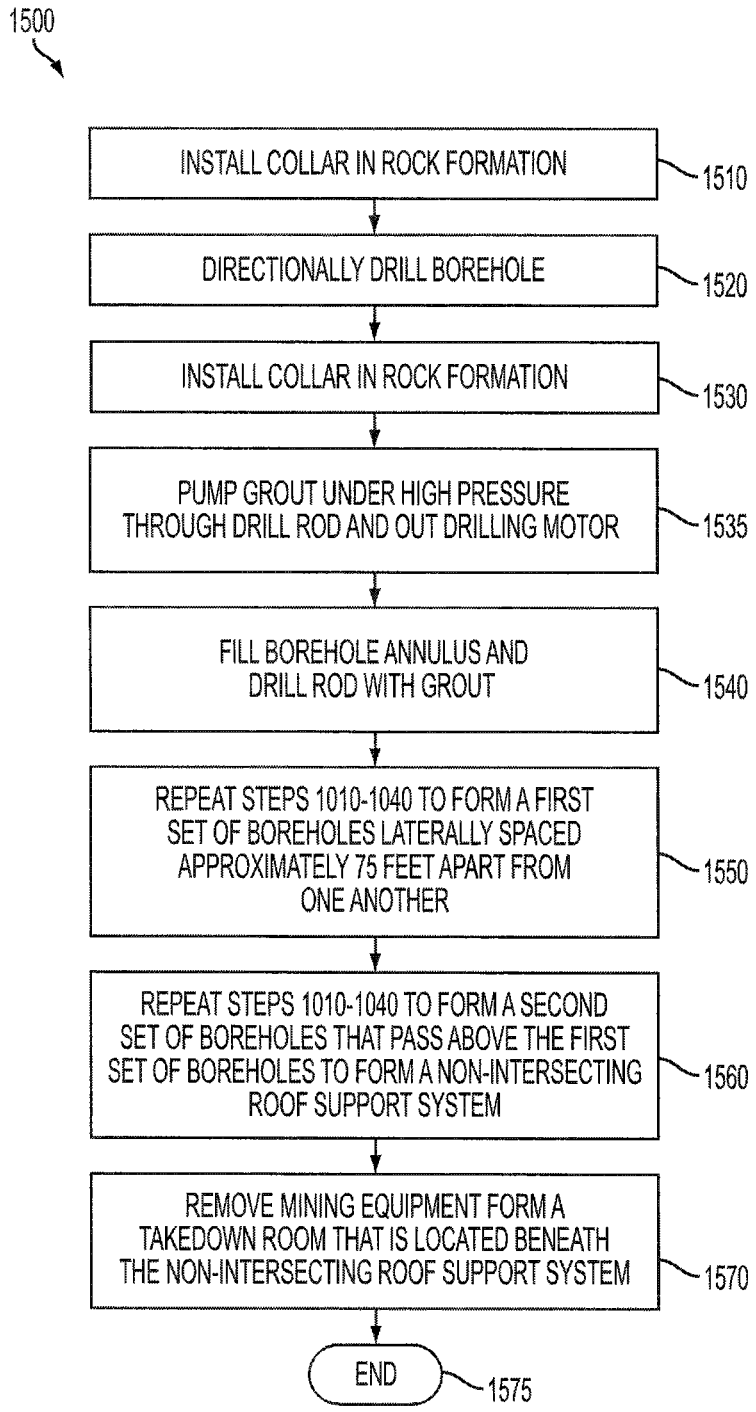
FIG. 15 is a flow chart of a process for installing a directionally-drilled sacrificial tooling (DDSTM) roof support system according to an exemplary embodiment.

Referring now to FIG. 15, a flowchart of a process 1500 for installing a DDSTM roof support system is shown. At step 1510, a collar is installed into a rock face at a location where a borehole will be drilled. The collar facilitates use of drilling equipment to drill the borehole. At step 1520, the borehole is directionally drilled such that a portion of the borehole passes generally perpendicular to and approximately 10 feet above a face of a coal seam. At step 1530, the directional drilling motor and the sacrificial drill rod is left in place in the borehole. At step 1535, grout is pumped under high pressure through the sacrificial drill rod and out the end of the directional drilling motor. At step 1540, the borehole annulus and the drill rod are filled with grout under high pressure until the borehole is full. At step 1550, steps 1510-1540 are repeated at additional locations to form a first set of boreholes that spans the length of the coal seam face such that each borehole passes over the face of the coal seam in a generally perpendicular direction and such that each borehole is laterally spaced about 75 feet from neighboring boreholes. At step 1560, steps 1510-1540 are performed at new locations to create a second set of boreholes that cross over the first set of boreholes to form the cable roof support system. Each of the second set of boreholes passes over the face of the coal seam at a height that is approximately 5 feet above the first set of boreholes. At step 1570, mining equipment is removed from a takedown room that is located beneath the cable roof support system. At step 1575, the process 1500 ends.

Although various embodiments of the method and system of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. A system for supporting a roof of a subterranean mine, the system comprising:

a first plurality of non-linear stabilizing members disposed underground above the roof of the subterranean mine at a first elevation, the first plurality of non-linear stabilizing members terminating at a second elevation, the first plurality of non-linear stabilizing members having tension applied thereto via a fastener plate assembly disposed only at a first end of the first plurality of non-linear stabilizing members;

a second plurality of non-linear stabilizing members disposed above the roof of the subterranean mine and above the first plurality of non-linear stabilizing members at a third elevation, the second plurality of non-linear stabilizing members terminating at a fourth elevation, the second plurality of non-linear stabilizing members having tension applied thereto via a fastener plate assembly disposed only at a first end of the second plurality of non-linear stabilizing members;

wherein, the first plurality of non-linear stabilizing members and the second plurality of non-linear stabilizing members are arranged to form a mesh; and wherein weight of the roof of the subterranean mine is distributed to a surrounding structure via the first plurality of stabilizing members and the second plurality of stabilizing members.

2. The system of claim 1, wherein:

the first plurality of non-linear stabilizing members comprises a first plurality of cables; and the second plurality of non-linear stabilizing members comprises a second plurality of cables.

3. The system of claim 2, wherein:

the first plurality of cables are contained within a first plurality of boreholes; and the second plurality of cables are contained within a second plurality of boreholes.

4. The system of claim 2, wherein at least one cable of the first plurality of cables comprises a plurality of bulbs disposed along a length of the at least one cable.

5. The system of claim 4, wherein the plurality of bulbs are spaced approximately five feet apart.

6. The system of claim 2, wherein at least one cable of the second plurality of cables comprises a plurality of bulbs disposed along a length of the at least one cable.

7. The system of claim 2, wherein at least one cable of the first plurality of cables and the second plurality of cables is disposed in an inter-layered fan pattern.

8. The system of claim 2, wherein at least one cable of the first plurality of cables and the second plurality of cables is secured via the fastener plate assembly.

9. The system of claim 2, wherein at least one cable of the first plurality of cables and the second plurality of cables is secured via a fish hook assembly, the fish hook assembly comprising an end cap having at least one barb projecting therefrom.

10. The system of claim 1, wherein:

the first plurality of non-linear stabilizing members comprise a first plurality of sacrificial drill rods; and the second plurality of non-linear stabilizing members comprise a second plurality of sacrificial drill rods.

11. The system of claim 10, wherein the first plurality of sacrificial drill rods and the second plurality of sacrificial drill rods comprise directional drilling motors.

12. The system of claim 10, wherein at least one sacrificial drill rod of the first plurality of sacrificial drill rods and the second plurality of sacrificial drill rods is arranged in an inter-layered fan pattern.

13. The system of claim 1, wherein the first elevation and the second elevation are not equal.

14. The system of claim 1, wherein the third elevation and the fourth elevation are not equal.

15. A method of forming subterranean mineworkings, the method comprising:

installing a first plurality of non-linear stabilizing members in a roof region at a first elevation, the first plurality of non-linear stabilizing members terminating at a second elevation;

installing a second plurality of non-linear stabilizing members in the roof region above the first plurality of non-linear stabilizing members at a third elevation, the second plurality of non-linear stabilizing members terminating at a fourth elevation;

tensioning the first plurality of non-linear stabilizing members and the second plurality of non-linear stabilizing members via a fastener plate assembly disposed only at a first end of each of the first plurality of non-linear stabilizing members and the second plurality of non-linear stabilizing members;

wherein the first plurality of non-linear stabilizing members and the second plurality of non-linear stabilizing members are arranged to form a mesh; and creating a subterranean mine in a region of earth underlying the roof region.

16. The method of claim 15, wherein:

the first plurality of non-linear stabilizing members comprises a first plurality of cables; and the second plurality of non-linear stabilizing members comprises as second plurality of cables.

17. The method of claim 16, further comprising:

drilling a first plurality of boreholes for placement of the first plurality of cables therein; and drilling a second plurality of boreholes for placement of the second plurality of cables therein.

18. The method of claim 16, further comprising arranging at least one cable of the first plurality of cables and the second plurality of cables in an inter-layered fan pattern.

* * * * *